US006138878A

United States Patent [19]

Savage et al.

[11] Patent Number: 6,138,878

[45] Date of Patent: Oct. 31, 2000

[54] TAPS AND CONTAINERS FOR DISPENSING FLUID

[75] Inventors: Chester Savage, Irvine; Rocklin Verespej, San Clemente, both of Calif.

[73] Assignee: Scholle Corporation, Irvine, Calif.

[21] Appl. No.: 09/193,325

[22] Filed: Nov. 16, 1998

[51] Int. Cl.[7] ..... B67D 5/06

[52] U.S. Cl. ..... 222/517

[58] Field of Search ..... 222/105, 517, 222/556, 508

[56] References Cited

U.S. PATENT DOCUMENTS

| | | | |
|---|---|---|---|
| 4,693,400 | 9/1987 | Frahm et al. | 222/518 |
| 5,000,359 | 3/1991 | Scholle et al. | 222/517 |

*Primary Examiner*—Philippe Derakshani

*Attorney, Agent, or Firm*—Terry L. Miller

[57] ABSTRACT

A tap for dispensing fluid from a vessel includes a main tap body, an actuator, and a seal member. The main tap body includes a passage with an inlet and an outlet and a seat with a shoulder formed around the outlet. The actuator has a handled and is pivotally attached to the main tap body and dispenses fluid from the vessel upon activation of the handle by a user. The seal member is received within the seat and attached to the actuator. The seal member includes a retaining portion received against the shoulder of the seat and a sealing portion which is releasably engageable with the seat. The seal member is resilient to provide a bias force to urge the sealing portion against the seat. The actuator is pivotal between a closed position in which the sealing portion is biased against the seat, thereby preventing fluid from passing through the outlet, and an opened position in which at least a portion of the sealing portion is pulled away from the seat against the bias force, thereby allowing fluid to flow through the outlet.

25 Claims, 4 Drawing Sheets

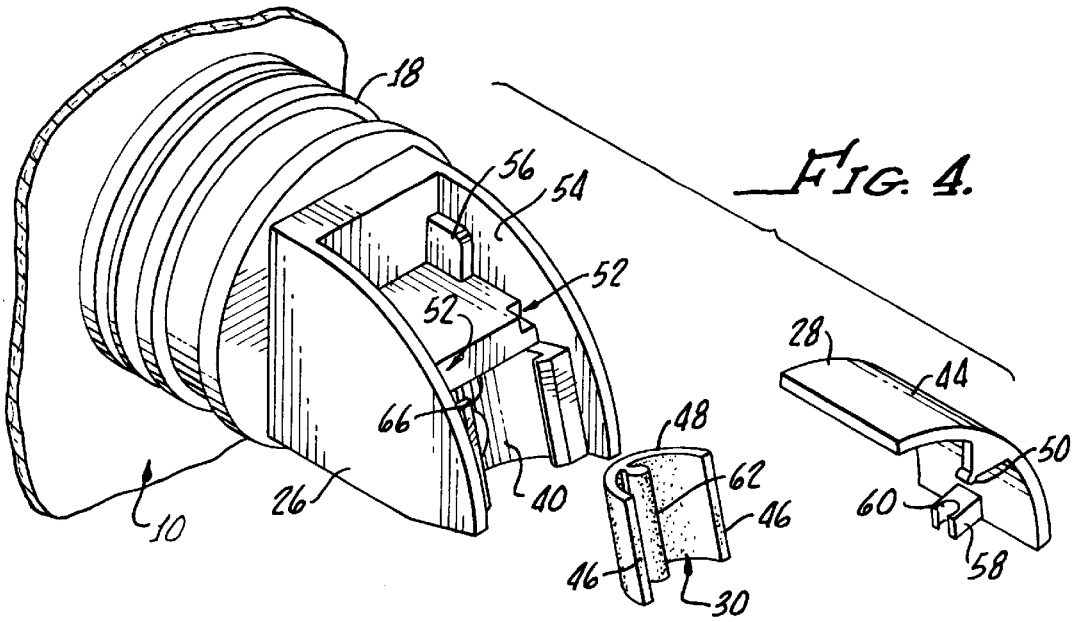
FIG. 4.
FIG. 5.
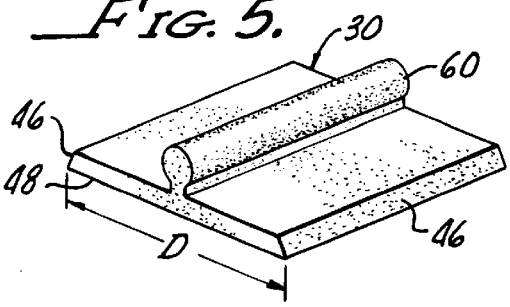
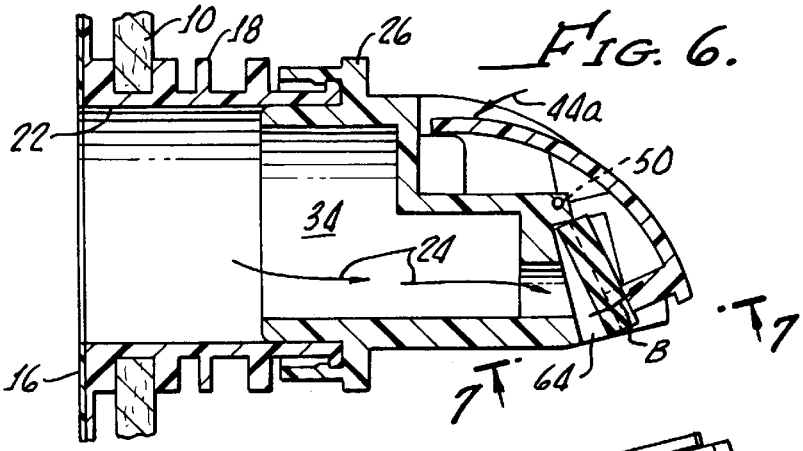
FIG. 6.
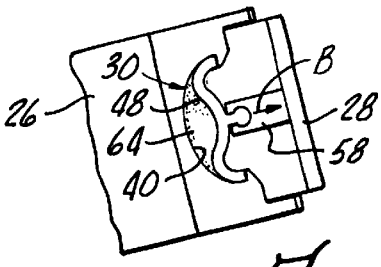
FIG. 7.

FIG. 8.
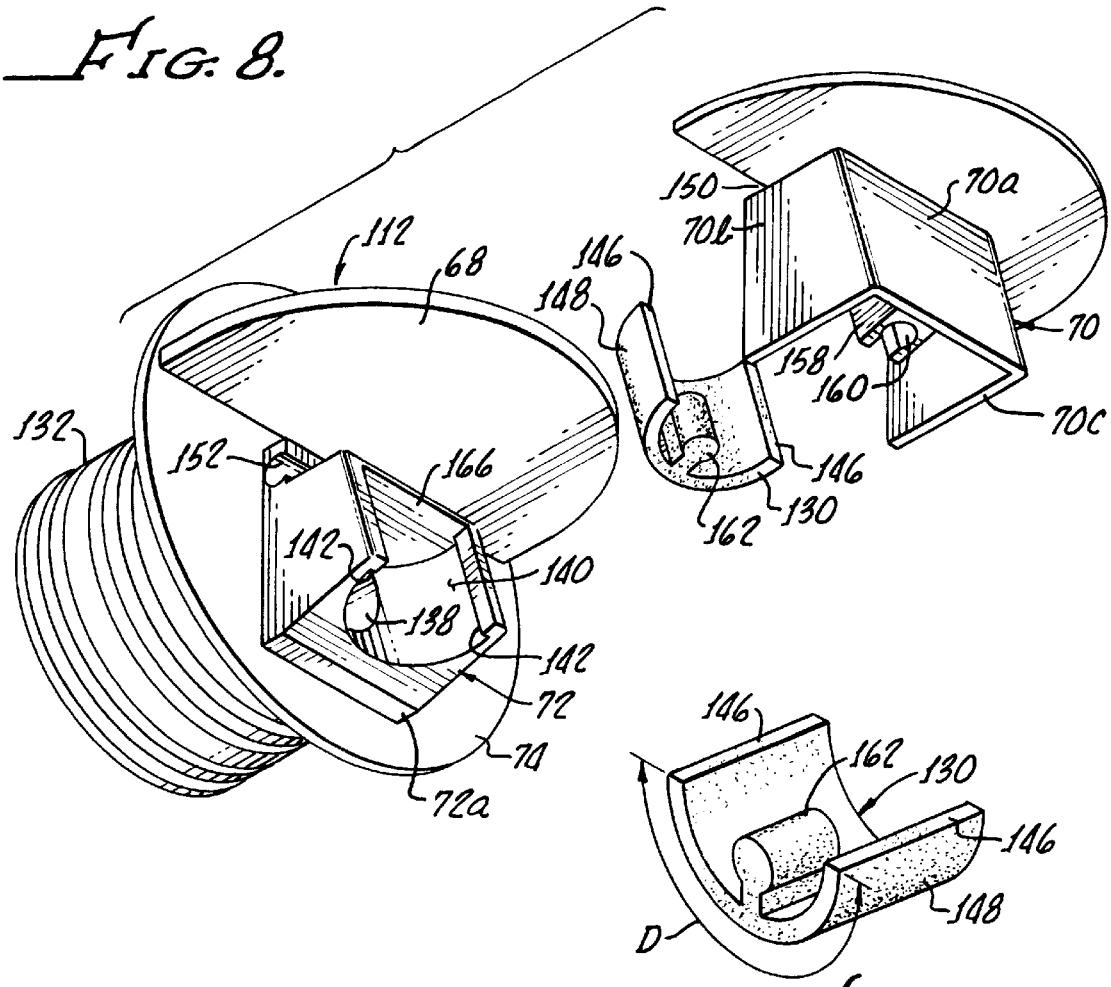
FIG. 8A.
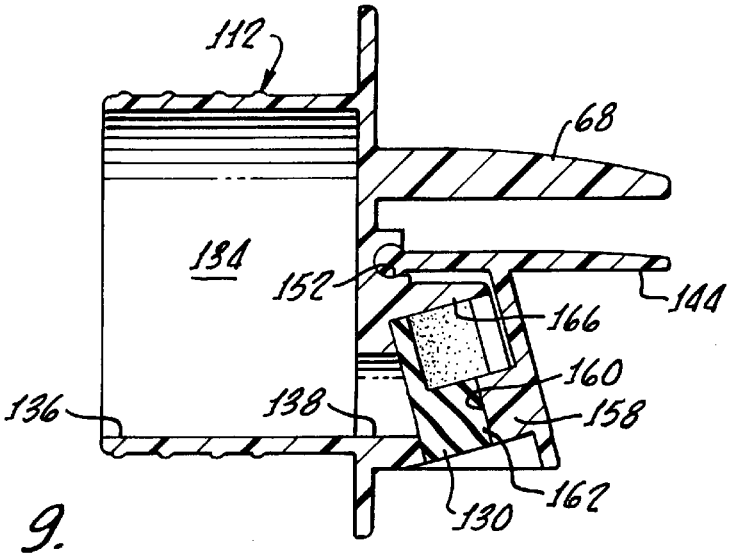
FIG. 9.
10 10

TAPS AND CONTAINERS FOR DISPENSING FLUID

BACKGROUND OF THE INVENTION

1. Field of the Invention

The present invention relates to a tap (i.e., a tap, valve, or spigot) for dispensing fluids and liquids. More particularly, the present invention relates to a tap used for dispensing liquid from a vessel or container. The present inventive tap may be used to dispense a fluid such as a beverage (e.g., wine) from a box-like vessel in which the beverage is packaged.

2. Description of the Related Art

There are many applications in which fluids are dispensed from containers. One common application is known in the commercial consumer market in which a liquid or beverage (such as wine) is packaged in a box-like container made of paper board and having a collapsible inner bag which holds the liquid. A tap is attached to the bag by use of a coupler secured to the bag, and has a resilient tab portion. This tab portion which may be pressed raised, for example, by a finger. When the tab is raised, the liquid within the container is dispensed through an opening below the tab.

One of the drawbacks of this type of tap is that the fluid is dispensed forwardly and downwardly from the front of the tap, immediately below the tab, rather than straight downwardly, directly below the tap. Thus, the user needs to exercise caution to prevent placing a container too far back under the conventional tap of this type and thus spilling the liquid over the front edge of the container. That is, the user has to exercise care to see that liquid dispensed goes into a container held under and slightly forward of the tap.

Conventional taps, valves, and spigots for use in the consumer market may be unduly complicated, such as those disclosed in U.S. Pat. No. 4,621,750 to Roethel and U.S. Pat. No. 4,927,061 to Leigh et al. The Roethel patent discloses a conventional valve assembly with two orthogonal passageways. A tube-like seal member is concentrically housed within one of passageways and is adapted to close a port between the two passageways. A lever pulls the seal member away from the port to open the valve. Like the device disclosed in the Roethel patent, Leigh et al. Teaches in the '061 patent, a valve assembly in which a tubular seal member is pulled away from an orifice to open the valve.

As many applications of valves involve situations in which the valve (and fluid-holding container) are discarded after a single use, the unit cost of the valve needs to be minimized. Accordingly, the tubular seal members of these two patents may present unnecessary costs. Also, the associated structure to house and retain the tubular seal member may be more expensive than is desired.

In view of the conventional approaches for dispensing fluid, there is a need in the art for a tap that dispenses fluid in an easy, reliable manner, and which is inexpensive.

SUMMARY OF THE INVENTION

In view of the foregoing an object of the present invention is to overcome one or more of the drawbacks of conventional fluid-dispensing taps.

Another object of the present invention is to provide a tap for dispensing fluid which is relatively streamlined in design and uncomplicated in production.

Still another object of the present invention is to provide a fluid-dispensing tap with relatively few components.

According to one aspect of the invention, a tap for dispensing fluid from a vessel includes a tap body defining a passage with an inlet, an outlet, and an arcuate concave seat formed at the outlet, the body providing a pair of spaced apart shoulders on opposite sides of the outlet; an actuator movably attached to the tap body for controllably dispensing fluid along the passage from the outlet upon activation; and a seal member received within the arcuate concave seat and between the pair of spaced apart shoulders, the seal member including a spaced apart pair of retaining portions each received against a respective one of the pair of shoulders and a sealing portion intermediate of the pair of retaining portions for in a first position sealingly engaging releasably against the seat, the seal member being of yieldable, shape-retaining resilient nature, and being strained in engagement with the seat for providing a self- bias force urging the sealing portion sealingly against the seat.

One of the advantages of the present invention is that the tap may be manufactured with essentially only three primary elements or components; that is, the main body, the seal member, and the actuator, thereby eliminating many of the parts which complicate conventional taps. Accordingly, the tap of the present invention is easily and inexpensively produced. Because of this low production cost, the tap is economically disposable. Also, the tap required little raw material so that the environmental impact of its disposal is not severe. In this regard, the tap may be economically applied in many consumer or retail applications such as those in which a beverage is packaged in a single-use bag-in-box container which is discarded along with the tap after the container is emptied.

According to another aspect of the invention, the seat for receiving the seal member is preferably substantially arcuate in configuration. Accordingly, the sealing portion is flexible to be placed in an arcuate configuration that is complementary to that of the seat. By being flexed into such an arcuate configuration, the sealing portion provides its own bias force to maintain the tap closed when the actuator is not being manually actuated to dispense liquid. To facilitate the sealing fit of the seal member within the arcuate seat, it is preferable to configure the retaining portion of the seat such that when the sealing portion is in the arcuate configuration, the retaining portion is substantially coplanar with the shoulder.

Other aspects of the invention include the attachment of the seal member to the actuator and the actuator to the main tap body. To attach the seal member to the actuator, the actuator may include a stem and the seal member may include a spine attached to the stem. The spine is preferably disposed on the sealing portion of the seal member in a substantially longitudinal orientation. Accordingly, when the actuator pivots, the stem pulls on the spine which deflects the sealing portion along flexure lines generally paralleling the spine, and away from sealing engagement with the seat, thereby forming a channel through which fluid may flow from the tap.

To pivotally attach the actuator to the main tap housing, for example, the actuator may include at least one axle and the main tap body may include a complementary elongate socket for pivotally receiving the axle. In addition, the main tap housing may include a recess for receiving the handle when the actuator pivots to the opened position, and a block for obstructing further pivoting of the actuator in the opened position.

According to another aspect of the present invention, a container for holding and dispensing fluid includes a vessel and a tap. The tap includes a main tap body, an actuator, and a seal member. The main tap body includes a passage with an inlet and an outlet and a seat with a shoulder formed adjacent to the outlet. The actuator has a handle (i.e., a manually engageable portion) and is pivotally attached to the main tap body and dispenses fluid from the vessel upon activation of the handle by a user. The seal member is received within the seat and attached to the actuator. The seal member includes a retaining portion received against the shoulder of the seat and a sealing portion which is releasably engageable with the seat. The seal member is resilient to provide a self-bias force urging the sealing portion against the seat. The actuator is pivotal between a closed position in which the sealing portion is biased against the seat (thereby preventing fluid from passing through the outlet), and an opened position in which at least a portion of the sealing portion is pulled away from the seat against the self-bias force (thereby allowing liquid to flow through the outlet).

Other objects, features, and advantages of the present invention will become apparent to those skilled in the art from a consideration of the following detailed description taken in conjunction with the accompanying drawings.

BRIEF DESCRIPTION OF THE DRAWING FIGURES

FIG. 4 is an exploded perspective view of the exemplary tap illustrated in FIG. 1;

FIG. 5 is a perspective view of an exemplary seal member according to the present invention and in an un-distorted condition;

FIG. 6 is a cross-sectional view similar to that of FIG. 2, particularly illustrating the tap when open and allowing fluid to dispense;

FIG. 7 is a plan view taken along line 7—7 of FIG. 6, further illustrating the tap when open and allowing liquid to dispense; and FIG. 8 provides an exploded perspective view of an alternative embodiment of the invention;

Figure 10:
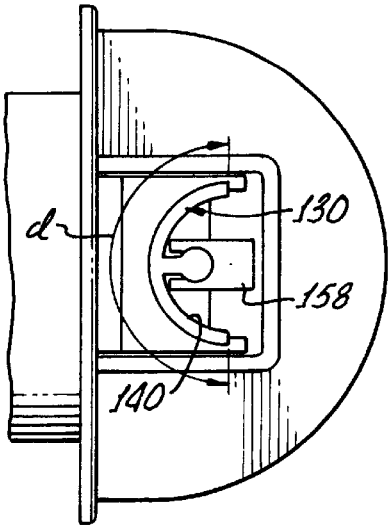
Figure 11:
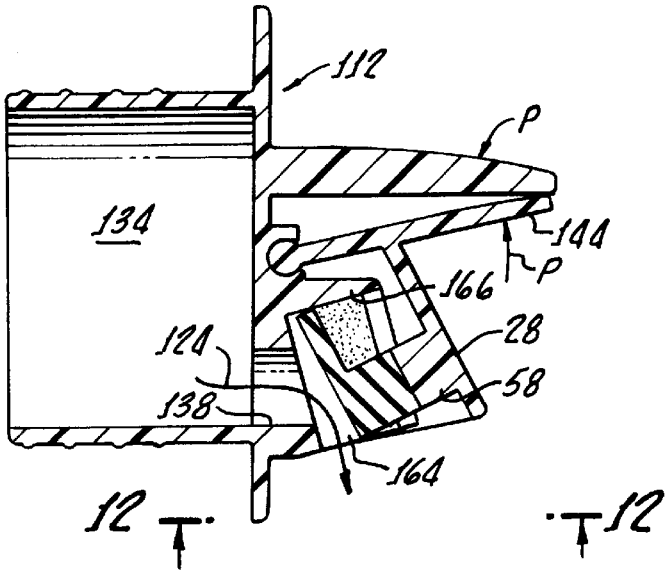
Figure 12:
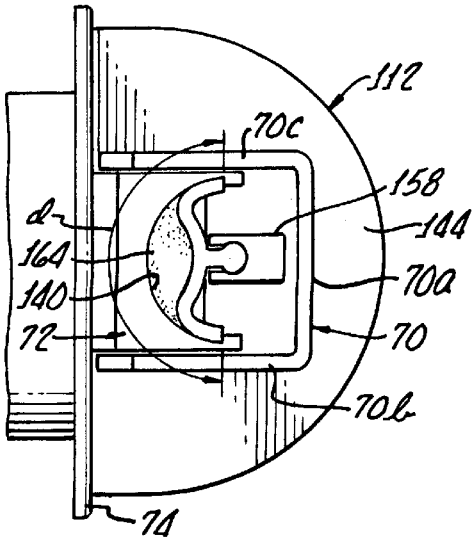

FIG. 8A provides an enlarged perspective view of a seal member which is also seen in FIG. 8;

FIG. 9 is a side elevation view of the tap seen in FIG. 8, and is presented in cross section;

FIG. 10 is a view taken at line 10—10 of FIG. 9;

FIG. 11 is similar to FIG. 9, but shows the tap opened to allow liquid to dispense; and FIG. 12 is similar to FIG. 10, but is taken at line 12—12 of FIG. 11 and shows the tap in an opened position.

DETAILED DESCRIPTION OF EXEMPLARY PREFERRED EMBODIMENTS OF THE INVENTION

Figure 1:
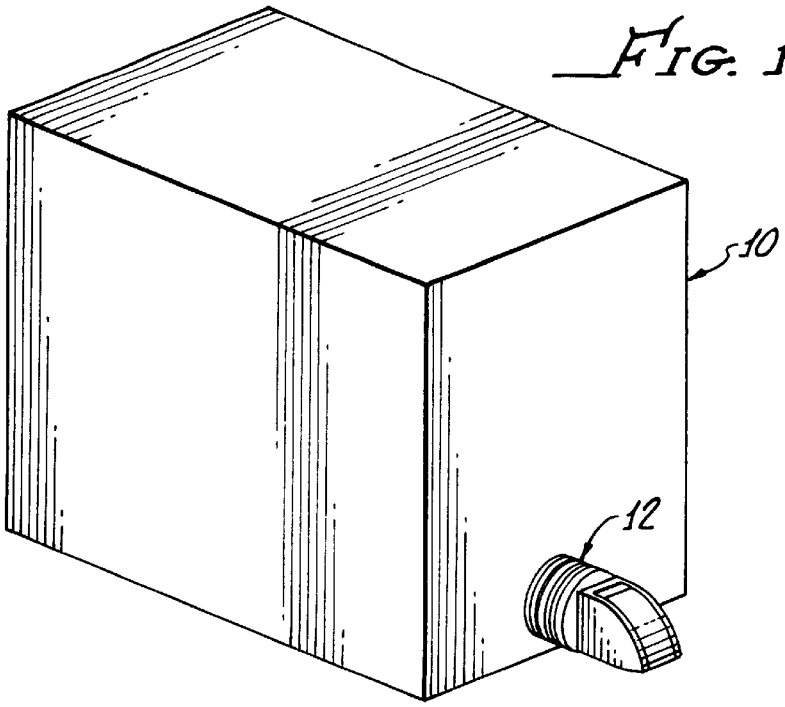
FIG. 1 is a perspective view of an exemplary fluid-dispensing tap mounted to a bag-in-box container in accordance with the present invention.
Figure 2:
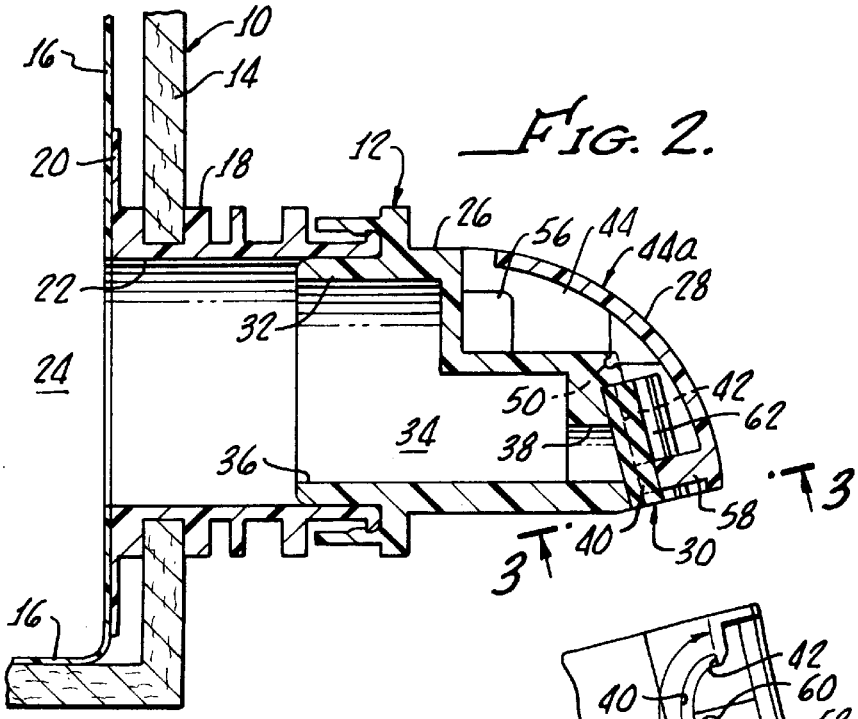
FIG. 2 is a cross-sectional view of the exemplary tap of FIG. 1, particularly illustrating the tap when closed and preventing fluid from dispensing.

Referring to the drawings in more detail, an exemplary bag-in-box container 10 for holding a liquid, such as wine, and an exemplary tap 12 for controllably dispensing the liquid from the container 10, are both illustrated in FIG. 1. With additional reference to FIG. 2, the container 10 includes an outer shape-retaining support structure or box 14 and an inner flexible bag 16. The box 14 may be made of, for example, corrugated paper board, and the bag 16 is made from a substantially liquid-impervious material, such as from plastic sheet. As is shown in FIG. 2, the container 10 also includes a coupler 18, preferably fabricated of a pliable but substantially shape-retaining polymer material. The coupler 18, which is shown as a female coupling part in this embodiment, is preferably substantially tubular in configuration and has a flange 20 disposed at an inner end thereof. The flange 20 is sealingly attached to the bag 16 at an opening 22 of the bag. For example, the flange 20 may be heat-sealed to the bag 16 at the opening 22. It will be understood that the box 14 is shape-retaining in nature, and may not be liquid proof. Accordingly, the bag 16 is seen to form a variable-volume collapsible liquid-holding container within the box 14. The bag 16 holds a liquid 24. This bag-in-box construction is described for contextual purposes and is well known.

Figure 3:
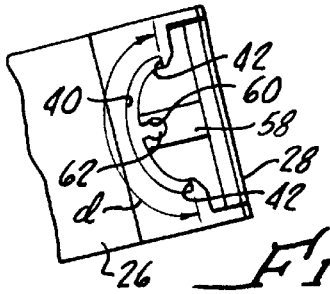
FIG. 3 is a view taken along line 3—3 of FIG. 2, further illustrating the tap when closed and preventing fluid from dispensing.

Referring more particularly to FIGS. 1, 2, and 3 of the drawings, exemplary tap 12 is configured in accordance with the teachings of the present invention. For purposes of explanation and without limiting the scope of the present invention, exemplary tap 12 is illustrated as a tap for dispensing liquid from a bag-in-box container 10, but the invention is not so limited. As such, the tap 12 implemented for this particularly preferred exemplary embodiment of the invention is configured to sealingly interface with the coupler 18 carried by the bag 20 of the bag-in-box container 10. However, those ordinarily skilled in the pertinent arts will understand that a tap embodying the present invention may be configured differently to interface with other containers, vessels, or fluid conduits. In the present case, the fluid 24 in the container 10 may be a beverage such as wine. Because of the nature of the bag-in-box container 10, the pressure head of the liquid 24 is only a few inches of liquid. However, a valve or tap according to the present invention may be configured to control the flow of liquid at a higher pressure, as will be apparent to those ordinarily skilled in the pertinent arts.

The teachings of the present invention may be readily applied to taps configured for dispensing liquids and semi-liquids of all types (for example, condiments, chemicals, and water) from vessels of all types (for example, from bottles, jugs, barrels, and from conduits or pipes). In addition, while the embodiment of the present invention presented herein has a particular feature for allowing manual manipulation of an actuator portion of the tap in order to open the tap to allow dispensing of liquid and to allow the tap to self-close when the manual manipulation is discontinued, this feature is not limiting or exhaustive of the invention. For example, an actuator of a tap embodying the present invention may be provided with a wide variety of particular features allowing either or both a manual, mechanical, or electrical actuation of the tap to controllably dispense liquids, and fluids through the tap.

To describe the first exemplary tap 12 of the invention in more detail, reference is made to FIGS. 1, 2, 3, and 4 of the drawings. The tap 12 includes a main tap body 26 sealingly mountable to the container 10 via coupling 18, an actuator 28 for manipulation (pushing with a finger tip) by a user, and a seal member 30. The main tap body 26 includes a mating portion 32 for attaching to the coupler 18 of the container 10. Mating of the portion 32 with the coupling 18 may be accomplished in ways well known in the art. The exemplary main tap body 26 also includes a through passage 34 with an inlet 36 and an outlet 38. The passage 34 is in liquid-flow communication with the fluid-holding bag 16 within the container 10, as is best seen in FIG. 2. Thus, fluid from the bag 16 is dispensed through the outlet 38 when the tap 12 is opened, which will be discussed in more detail below.

An arcuate seating surface 40 (best seen in FIGS. 3 and 4) is formed at the outlet 38 of the passage 34, and has a spaced apart pair of shoulders 42 formed at opposing ends 44 thereof. The seating surface 40 is semi-circular or semi-elliptical in section (as is seen best in FIG. 3). Thus, the seating surface 40 is semi-cylindrical, and is disposed angularly with the cylindrical axis of the surface in a generally vertical orientation, as is seen in FIG. 4. That is, considered in a generally axially extending central vertical plane, the axis of curvature for surface 40 extends substantially vertically, while if this surface 40 is considered in a vertical plane orthogonal to the axial plane of tap 12, then it would be seen that the surface 40 is angulated to cut across this orthogonal vertical plane. Further, it will be noted in FIG. 3 that the shoulders 42 are separated by an arcuate dimension "d" measured about the surface 40.

The actuator 28 is pivotally attached to the main tap body 26 (the structure for which will be discussed in more detail below) and includes a handle 44 for easy manipulation by a user to dispense the fluid 24 from the container 10. For example, the handle portion 44 may receive an actuating force, indicated on FIG. 2 by arrowed numeral 44*a*, which force is supplied by a finger tip pressing on the handle portion 44 of the actuator 28 approximately at the location indicated by this arrow.

The seal member 30 (seen in a relaxed or un-distorted condition in FIG. 5) includes retaining portions 46 and a sealing portion 48. The retaining portions 46 are defined by opposite side edges of the seal member 30, while the retaining portion 48 is defined by a generally planar intermediate portion of the seal member. The retaining portions 46 are each configured to be received against respective ones of the shoulders 42 on opposite sides of the seating surface 40. The sealing portion 48 is configured to be releasably engageable with the seating surface 40 in between the shoulders 42. At least the sealing portion 48 of the seal member 30 is made from resilient, but shape retaining, yieldable material so that the sealing portion 48 by its distortion or straining from the generally planar configuration seen in FIG. 5 in part provides a self-bias force when flexed. Further, the seal member 30 is somewhat compressed against the arcuate seating surface 40 between the pair of shoulders 42. More specifically, it is seen in FIG. 5 that the unstrained and undistorted seal member 30 has a dimension "D" which will lie along the curve of the surface 40 when the seal member is installed on this surface and between the shoulders 42. The dimension "D" slightly exceeds dimension "d" (i.e., if the latter were straightened out to also be linear), so that the seal member 30 is somewhat circumferentially compressed against the surface 40 and between shoulders 42, and is also urged radially outward (i.e., with respect to the center of curvature of surface 40) by the inherent resilience of the seal member 30 itself. Thus, the sealing member 30 is self-biased both to return toward a substantially planar configuration (i.e., a "normal" plate-like configuration), such as that shown in FIG. 5, when flexed or bent in a substantially curved configuration against the seat surface 40, such as is shown in FIG. 4, and is also circumferentially compressed or strained against the surface 40.

As shown in the drawings, the seating surface 40 is preferably curved or arcuate in configuration. More particularly, the sealing member 30 has a curved configuration that is complementary to the curved configuration of the seating surface 40 when the seal member 30 is flexed from its generally planar shape of FIG. 5 to the shape shown in FIG. 4. In addition, the seal member 30 and the seat surface 40 are preferably configured in such a way that the sealing portion 48 of seal member 30 particularly must be compressed along the arcuate line of the surface 40 somewhat between the shoulders 42 in order to for the sealing member 30 to be received between these shoulders 42. Accordingly, the seal member 30 in this flexed configuration provides a self-bias force against seating surface 40 which is sufficient to overcome the pressure head of liquid acting on the seal member at the outlet 38. Thus, the sealing member 30 sealingly engages in a first position against the surface 40 to seal liquid from coming out of outlet 38.

The actuator 28 is pivotally (i.e., tiltingly or rockingly) disposed on the main tap body 26 so that when the actuator 28 is manually pivoted by a user, the fluid-tight seal formed between the seal member 30 and the main tap body 26 at surface 40 is opened or disengaged, allowing fluid within the container 10 to dispense (this will be seen in FIGS. 6 and 7). More specifically, with additional reference to FIGS. 6 and 7, the actuator 28 is pivotal from the first position seen in FIG. 2, and to an open position in which the sealing portion 48 is pulled away from the arcuate seat 40 against the self-bias force, thereby allowing fluid to flow through the outlet 38, as shown in FIGS. 6 and 7.

As mentioned above, preferably the actuator 28 is pivotally attached to the main tap body 26. Such pivotal attachment may be accomplished a variety of ways. For example, the actuator 28 may have at least one (but preferably has a pair on protruding axles or pintles 50 (only one of which is seen in FIG. 4). These pintles 50 pivotally engage with complementary sockets 52 formed on the main tap body 26 (again, only one of the sockets 52 is seen in FIG. 4, but the approximate location of the other socket is indicated by the arrowed reference numeral 52). The sockets 52 act as fulcrums for the pivotal actuator 28. The main tap body 26 defines a recess 54 for accommodating the handle portion 44 of the actuator 28. As is shown in FIGS. 2 and 6. In addition, the main tap body 26 defines a protruding block 56 (or a spaced apart pair of such blocks—only one of which is visible in FIG. 4) positioned within the recess 54 to limit the movement of the actuator 28, thereby limiting the flexing movement of the seal member 30 within a preferred or predetermined range.

Although those skilled in the art may imagine many suitable alternative approaches for attaching the actuator 28 to seal member 30, a single exemplary structural cooperation for coupling the seal member 30 to the actuator 28 is particularly illustrated in FIGS. 2, 3, 4, 5, 6, and 7. To accomplish the necessary coupling, a stem 58 with a clip 60 is disposed on the actuator 28, and a spine 62 is defined on the seal member 30, preferably along a central longitudinal axis thereof (which parallels the cylindrical axis of the seat surface 40, and which will be discussed in more detail below). The spine 62 is receivable within the clip 60. As shown, the clip 60 and the spine 62 are configured complementarily, for example, with circular configurations. The spine 62 may be received in the clip 60 either by snapping the spine into the clip or by sliding the spine into the clip axially of the length of this spine. The force retaining the spine 62 within the clip 60 is substantially greater than the bias force applied by the flexed sealing portion 48 in order to ensure that the spine does not dislodge from the clip during use. Alternatively, the spine 62 (or other portion of the seal member 30 intermediate of the retaining portions 46 at the opposite side edges of this seal member) may be permanently attached to the stem 58 (or to another portion of the actuator 28). For example, during the manufacturing process of the tap 12, a rivet could be sealingly passed through a hole defined by the seal member 30 and engage into the actuator 28 approximately at the location of the stem 58.

With particular reference now to FIG. 5, in order to facilitate and to ensure a sealing-tight fit of the seal member 30 against the seat surface 40, it is preferable to configure the seal member 30 at its opposite side edges (i.e., at the retaining portion 46) in a substantially trapezoidal manner. In other words, the side edge surfaces of retaining portion 46 of the seal member 30 slant inwardly from the surface of the sealing member 30 defining portion 48 (i.e., from the surface which contacts the seat surface 40). This description of the shape of the seal member 30 most clearly applies when this seal member is substantially planar (i.e., un-flexed) as is seen in FIG. 5. Accordingly, when the seal member 30 is flexed through approximately 180 degrees to be received between the shoulders 42 and against the seat surface 40 (i.e., to provide the self-bias force), the retaining portions 46 are then substantially coplanar with the shoulders 42 at opposite sides of the seat surface 40.

Referencing FIGS. 6 and 7 in particular, in operation to dispense liquid from the tap 10, a user applies force with a finger tip (indicated in FIG. 2 with arrow 44a), and urges the handle portion 44 of the actuator 28 downwardly into the recess 54. The actuator 28 accordingly pivots about the fulcrum defined by the axles 50 in the sockets 52, thereby drawing the stem 58 outward as indicated by arrows B of FIG. 6. The stem 58 accordingly pulls the spine 62 and the sealing portion 48 of the seal member 30 along spine 62 away from the seat surface 40. The elongate form of the spine 62 assists in defining the direction of flexure of the seal member, as is seen in FIG. 7. The seal member 30 flexes against its own inherent self-bias force, thereby defining a channel 64 (seem in FIGS. 6 and 7) opening generally downwardly. Upwardly, the channel 64 becomes small because the stem 58 is disposed near the lower extent of seal member 30. Further, the upper extent of channel 64 is blocked by a web 66 of body 26, and traversing the seating surface 40 at the upper extent of this surface. Liquid 24 from the container 10 now is able to flow through the passage 34 and out of the tap 12. As shown, in the additionally flexed position of FIGS. 6 and 7, the sealing portion 48 deflects generally into a serpentine shape having a curvature generally perpendicular to the length of the spine 62 so as to define the channel 64.

When the handle 44 is released by the user, the resiliency of sealing member (i.e., portion 48) urges the sealing member 30 at portion 48 back toward the seat surface 40 in a spring-like manner to seal the outlet 38, thereby stopping the flow of the fluid 24 from the container 10. Accordingly, is it seen that the seal member 30 may be selectively moved manually between a closed position in which fluid is prevented from dispensing, as shown in FIGS. 2 and 3, and an opened position in which fluid dispenses from the container 10, as shown in FIGS. 6 and 7. When manual actuation force is discontinued, the seal member 30 moves by its own resilience back to a sealing position, closing fluid flow from the container 10.

The seal member 30 is preferably a unitary element formed or molded from resilient material such as natural or synthetic rubber. This resiliency enables the sealing portion 48 of the seal member 30 to provide because of its initial deflection into the seat surface 40, and because of additional deflection when the tap 10 is opened, all of the biasing force necessary to urge the sealing portion 48 toward the complementary seat surface 40. Because of its resilient nature, the sealing portion 48 continues to apply the self-bias force when the seal member is deflected so that when the user releases the handle 44, the sealing portion 48 snaps or springs from the deflected configuration shown in FIGS. 6 and 7 to the less deflected configuration in the closed position of the tap as is shown in FIGS. 2 and 3.

Turning now to a consideration of FIGS. 8–12, an alternative embodiment of the present tap is illustrated. In order to obtain reference numerals for use in describing this alternative embodiment of the tap according to the present invention, features of FIGS. 8–12 which are the same as, or which are analogous in structure or function to, features depicted and described above by reference to FIGS. 1–7 are indicated on FIGS. 8–12 using the same numeral used above, and increased by one-hundred (100).

Tap 112 includes a main tap body 126 sealingly mountable to a container 10 (not illustrated in FIGS. 8–12) via a coupling 18 (also not shown). An actuator 128 for manipulation (i.e., pinching along with a flange portion of the tap body [which is to be described below] between a thumb and one or more fingers) by a user, and a seal member 130, are also carried by the body 126. The main tap body 126 includes a mating portion 132 for attaching to a coupler of a container, for example. The exemplary main tap body 126 also includes a through passage 134 with an inlet 136 and an outlet 138.

In this case, however, the actuator 128 has a different configuration than the actuator 28, and provides a handle portion 144 which is configures as a semi-circle in plan view. Vertically spaced from and juxtaposed to the handle portion 144, the housing 126 defines a semi-circular protruding flange 68, which is positioned and spaced somewhat above the web 166. Between this flange 68 and the web 166, the body 126 defines a transversely extending groove 152. Groove 152 is just above web 166. At the edge of handle portion 144 adjacent to the body 126, the actuator 128 defines a transversely extending rib 150 (best seen in FIGS. 9 and 11, and only a portion of which is visible in FIG. 8). The rib 150 is snapped or slid laterally into the groove 152, and is pivotally received therein so that the actuator 128 is pivotally carried on body 126.

In this case, the actuator 128 defines a U-shaped depending channel, indicated with reference numeral 70, which includes a front wall 70*a,* and a pair of spaced apart side walls 70*b* and 70*c*. The channel 70 fits slidably over a boss (generally indicated with numeral 72) protruding forwardly of a vertically disposed flange portion 74 of the body 126. The opening 138 is defined in boss 72 as is seen in FIG. 8. Further, the channel 70 has a lower edge 70*c* which is disposed generally at an elevation coextensive with the lower edge 72*a* of the boss 72. Thus, as is seen in FIG. 9, the channel 70 of the actuator hides the boss 72. Actuator 128 carries a stem 158 having a clip feature 160, functionally equivalent to those features described above.

However, with the embodiment of the present tap illustrated in FIGS. 8–12, the tap is actuated by applying a pinching force, as is illustrated in FIG. 11 by the arrows "P". This pinching force might most conveniently be applied with the thumb and an opposed index finger, for example. The pinching force "P" moves the handle portion 144 upwardly to engage with the flange 68, pulling the stem 158 and spine 160 so that a lower portion of the seal member 130 is pulled from sealing engagement with the seating surface 140, creating the flow path 162 seen best in FIG. 12. When the pinching force "P" is discontinued, the sealing member 130 provides the self-bias necessary to close the tap 112.

Further, viewing FIG. 8A in particular, it is seen that in this case the seal member 130 is of arcuate shape in its undistorted or unstrained free shape. Again, as is best seen in FIG. 12, the seat surface 140 has a dimension "d" around the arcuate shape of this seat. As is seen in FIG. 8A, in this case, the seal member 130 has an arcuate dimension "D" which is again larger than the dimension "d" so that the seal member 130 is circumferentially compressed or strained between the pair of shoulders 142. It is believed that this arcuate configuration for the seal member 130 in its free shape better provides a strong resilient self-biasing force and preload of the seal member 130 against the seat surface 140.

In consideration of many embodiments of the tap 12 which may be used on retail consumer products, for example, in conjunction with the beverage container 10, the tap 12 may include a removable tamper-evident strip (not shown) positioned between the handle 44 and the main tap body 26 (or between the handle portion 144 and the flange 68 of the alternative embodiment). Prior to its removal, the tamper-evident strip prevents the actuator 28 (128) from pivoting, thereby preventing the dispensing of fluid 24 from the container 10. The tamper-evident strip may have a tab for grasping by a user to facilitate the removal the strip from the tap 12. The tamper-evident strip may be molded integrally with the main tap body 26 and may include a frangible connection or thin web of plastic material to connect with the body. Consequently, a user may remove the strip by breaking this frangible connection. Once broken, the tamper-evident strip cannot be returned to the original unbroken condition, and the opening of the tap 12 (or at least the removal of the tamper-evident strip) is apparent to a subsequent consumer who might otherwise purchase the container 10 and its contents.

Those skilled in the art will understand that the preceding exemplary embodiments of the present invention provide the foundation for numerous alternatives and modifications thereto. For example, rather than being configures for mounting to a box-like vessel 10 (i.e., a bag-in-box container), exemplary tap 12 may be configured to mount to a conduit end, to a curved surface, (i.e., at a barrel bung), or to a spigot or spout common to bottles and jugs. These other alternatives and modifications are also within the scope of the present invention. Accordingly, the present invention is not limited to that precisely shown and described herein.

We claim:

1. A tap for dispensing liquid, said tap comprising:

a tap body defining a passage with an inlet, an outlet, and an arcuate concave seat upon which said outlet opens, said body providing a pair of retention features spaced apart one on each side of the outlet;

a seal member received within said arcuate concave seat and between said pair of spaced apart retention features, said seal member including a spaced apart pair of retaining portions each received into engagement with a respective one of said pair of retention features and a sealing portion intermediate of said pair of retaining portions for in a first position arcuately engaging sealingly and releasably against said seat, said seal member being of yieldable, shape-retaining resilient nature, and being strained into engagement with said seat for providing a self-bias force urging said sealing portion sealingly against said seat; and an actuator movably attached to said tap body for moving said sealing portion of said seal member to a second position in which at least a part of said sealing portion is spaced from said outlet to controllably dispense liquid along said passage.

2. A tap as claimed in claim 1 wherein said arcuate seat extends substantially vertically.

3. A tap as claimed in claim 1 wherein said pair of retention features include a pair of spaced apart shoulders.

4. A tap as claimed in claim 3 wherein said sealing member is arcuately compressed between said pair of shoulders.

5. A tap as claimed in claim 1 wherein said sealing member provides said self-bias force in response to being flexed from a substantially planar un-strained shape into said arcuate shape which is complementary to said seat.

6. A tap as claimed in claim 1 wherein said sealing member provides said self-bias force in response to being circumferentially constrained at said pair of retention features and into arcuate engagement with said arcuate seat.

7. A tap as claimed in claim 3 wherein said retaining portion of said seal member is configured so that in said arcuate shape within said seat each of said pair of retaining portions at a marginal edge surface thereof is substantially coplanar with a respective one of said pair of shoulders.

8. A tap as claimed in claim 1 wherein said actuator includes a stem and said sealing member includes an elongate spine attaching to said stem.

9. A tap as claimed in claim 1 wherein said actuator includes a handle portion which is semi-circular in plan view, and said tap body defines a semi-circular flange extending in spaced apart generally parallel and vertically spaced juxtaposition to said handle portion.

10. A tap as claimed in claim 9 wherein said tap body includes a protruding boss upon which said outlet opens, said actuator including a U-shaped channel portion nesting with said boss.

11. A tap as claimed in claim 8 wherein said spine is disposed on said sealing portion in a substantially vertically extending centrally located position substantially intermediate of said retaining portions.

12. A tap as claimed in claim 11 wherein said sealing portion deflects substantially parallel with said spine to an opened second position in which said sealing portion is at least in part spaced from said arcuate seat and said seal member defines a serpentine shape in section.

13. A tap as claimed in claim 1 wherein said actuator and said tap body define cooperating means for defining a pivot axis for said actuator.

14. A tap as claimed in claim 13 wherein said cooperating means includes one of said actuator and tap body defining an axle portion, and the other of said actuator and tap body including a complementary socket for pivotally receiving said axle portion.

15. A tap as claimed in claim 1 wherein said tap body includes a recess movably receiving a handle portion of said actuator.

16. A tap as claimed in claim 12 wherein said tap body further defines a feature limiting movement of said actuator portion from said first toward said second position of said tap.

17. A container and tap combination for holding and controllably dispensing liquid, said container and tap combination comprising:

a container holding liquid, said container defining an outlet; and a tap closing said outlet for controllably dispensing liquid from said container, said tap including:

a tap body sealingly mounted to said container at said outlet and including a passage with an inlet communicating with the container, an outlet, a passage extending between the inlet and outlet, an arcuate seat surface upon which said outlet opens, and a pair of retention features spaced apart one on each opposite side of said outlet and seat surface;

a circumferentially discontinuous seal member received arcuately within said seat between said pair of retention features, said seal member including a pair of opposite marginal retaining portions each received in engagement with a respective one of said pair of retention features so that said seal member extends in a first position arcuately therebetween, and a sealing portion intermediate of said pair of retention features and releasably engaging said seat, said seal member being of shape-retaining, yieldably resilient nature for providing a self-bias force urging said sealing portion sealingly against said seat in said first position, said seal member being movable to a second position in which said sealing portion is at least in part spaced from said seat to allow liquid to flow from said outlet and said seal member has a serpentine shape in section;

an actuator movably associated with said tap body and transferring force to said seal member for dispensing fluid from the vessel upon actuation, and said actuator including a manually-engageable handle portion movable to effect selective movement of said seal member between said first and second positions;

whereby when actuation of said actuator is discontinued, said seal member substantially by self-bias returns to said first position and sealingly closes flow of liquid from said outlet.

18. A container and tap combination as claimed in claim 17 further comprising an inner flexible bag disposed within said container, said bag holding said liquid.

19. A container as claimed in claim 18 further comprising a coupler attached to said bag at said outlet; said tap body sealingly mating to said coupler.

20. A method for controllably dispensing fluid, said method comprising steps of:

providing a container having fluid therein, and an outlet;

providing a tap sealingly attaching to said container at said outlet;

providing said tap with a tap body sealingly mounting to said container at said outlet and including a passage with an inlet communicating with the container and fluid therein, an outlet, and a passage extending between the inlet and outlet;

providing an arcuate seat on said tap body at said outlet, and providing a pair of retention features spaced on opposite sides of said outlet and seat;

closing said outlet with a circumferentially discontinuous seal member received arcuately within said seat between said pair of retention features, configuring said seal member to include:

a pair of opposite marginal retaining portions each received in engagement with a respective one of said pair of retention features, and a sealing portion intermediate of said pair of retaining portions and in a first position releasably engaging said seat, making said seal member of a material which is of shape-retaining, yieldable resilient nature so that said seal member provides a self-bias force urging said sealing portion sealingly against said seat; and controllably moving said seal member to a second position in which at least a part of said sealing portion is spaced from said seat to allow fluid to flow from said outlet and said seal member has a serpentine shape in section;

utilizing an actuator movably associated with said tap body for dispensing fluid from the vessel upon actuation, and including in said actuator a handle portion movable manually to pivot said actuator between a respective first and second positions so that said seal member is moved respectively between said first and second positions.

21. The method of claim 20 further including the step of attaching said seal member at said sealing portion thereof to said actuator so that a lower extent of said sealing portion is pulled away from said seat in response to actuation of said actuator, and said seal member is responsively moved from said first position to said second position.

22. In a tap having a body defining a flow path with an inlet, an outlet, and a flow path extending from the inlet to the outlet, the method of controllably dispensing fluid from the tap comprising steps of:

providing an arcuate seat surface at said outlet, and providing an arcuate circumferentially discontinuous seal member in a first position sealingly received into said seat at said outlet to close the outlet, and in a second position having a portion of said seal member spaced from said outlet to allow fluid to flow therefrom while said seal member has a serpentine shape in cross section.

23. The method of claim 22 further including the step of configuring said seal member to be generally planar in an un-strained configuration with a substantially trapezoidal edge shape having opposite side edges.

24. The method of claim 23 further including the step of providing an elongate spine on said sealing member, and spacing said spine intermediate and substantially parallel with said opposite side trapezoidal edges.

25. A tap for controllably dispensing fluid, said tap comprising:

a tap body defining an inlet, an outlet, and a flow path communicating between the inlet and outlet, said tap body defining an arcuate seat at said outlet;

an arcuate, resilient, yieldably shape-retaining seal member sealingly strained and received in said arcuate seat in a first position in sealing relation with said tap body at said arcuate seat, in a second position said seal member being at least in part spaced from said tap body at said outlet to open said outlet and allow fluid flow therefrom while said seal member is of substantially serpentine shape in section at said a plan therethrough outwardly of said outlet;

actuator means for controllably moving said seal member between said first and said second positions, and said seal member in an un-strained condition being substantially more planar than in said strained position in said arcuate seat and providing a self-bias force toward said first position thereof.

* * * * *